US005393082A

United States Patent [19]

Fenley

[11] Patent Number: 5,393,082

[45] Date of Patent: Feb. 28, 1995

[54] ADJUSTABLE-TILT FOOTRESTS FOR WHEELCHAIRS

[76] Inventor: John M. Fenley, 1284 Devonshire Dr., San Diego, Calif. 92107

[21] Appl. No.: 205,784

[22] Filed: Mar. 4, 1994

[51] Int. Cl.[6] ..... A47C 7/52

[52] U.S. Cl. ..... 280/291; 280/304.1; 74/564; 297/423.19; 297/423.26

[58] Field of Search ..... 280/291, 304.1; 297/DIG. 4, 69, 70, 76, 423.18, 423.22, 423.23, 423.24, 423.34, 423.38, 423.19, 423.26; 74/564; 403/83, 84, 87, 110

[56] References Cited

U.S. PATENT DOCUMENTS

| | | | |
|---|---|---|---|
| 3,216,738 | 11/1965 | Bockus | 297/DIG. 4 |
| 3,249,388 | 5/1966 | Jennings | 297/DIG. 4 |
| 3,337,261 | 8/1967 | Nihlean et al. | 297/423.35 |
| 3,376,067 | 4/1968 | Kernes | 297/423.24 |
| 4,927,167 | 5/1990 | Davis | 280/291 |
| 5,141,250 | 8/1992 | Morgan et al. | 297/DIG. 4 |
| 5,190,391 | 3/1993 | Huong | 403/84 |

FOREIGN PATENT DOCUMENTS

| | | | |
|---|---|---|---|
| 0627136 | 9/1927 | France | 280/291 |

*Primary Examiner*—Karin L. Tyson
*Assistant Examiner*—Anne Marie Boehler

[57] ABSTRACT

A wheelchair with footrest supports having a pair of horizontal, parallel forwardly extending cylindrical rods comprising, a pair of blocks, each block having an upper bore positioned to receive and support an associated cylindrical rod of the wheelchair, each block having a horizontal lower bore perpendicular to the upper bore. A pair of foot supporting plates, each plate adjustably supported with respect to the block, each plate also having a pair of holes extending therethrough with bolts extending through the holes, each bolt having a complimentary nut. A pair of pivot bolts, each pivot bolt having a threaded end located adjacent to the side of the pivot block remote from the plate with a complimentary abutment surface and wingnut on opposite sides of the block for securing the pivot bolt to the block when positioned through the lower bore, each pivot bolt also having a pair of parallel holes extending therethrough aligned with the holes of the plate for securing the plate with respect to the bolt with a pair of small bolts and associated nuts to effect such coupling.

3 Claims, 4 Drawing Sheets

ADJUSTABLE-TILT FOOTRESTS FOR WHEELCHAIRS

BACKGROUND OF THE INVENTION

1. Field of the Invention

The present invention relates to adjustable-tilt footrests for wheelchairs and, more particularly, pertains to adjusting the tilt of wheelchairs with footrests.

2. Description of the Prior Art

The use of devices for supporting the feet of wheelchair users is known in the prior art. More specifically, supporting the feet of wheelchair users heretofore devised and utilized for the purpose of supporting users feet are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,011,227 to van Hekken et al. an adjustable footrest for a chair.

U.S. Pat. No. 4,770,467 to Zinn disclose a footrest unit for wheelchairs.

U.S. Pat. No. 4,538,857 to Engman discloses a foot rest arrangement for wheelchairs.

U.S. Pat. No. 4,410,215 to McKean et al. discloses a retractable leg rest for a chair.

U.S. Pat. No. 3,990,744 to Rodaway discloses a wheelchair foot rest.

In this respect, the adjustable-tilt footrests for wheelchairs according to the present invention substantially departs from the conventional concepts and designs of the prior art, and in doing so provides an apparatus primarily developed for the purpose of wheelchairs with footrest.

Therefore, it can be appreciated that there exists a continuing need for new and improved adjustable-tilt footrests for wheelchairs which can be used for wheelchairs with footrest. In this regard, the present invention substantially fulfills this need.

SUMMARY OF THE INVENTION

In view of the foregoing disadvantages inherent in the known types of supporting the feet of wheelchair users now present in the prior art, the present invention provides an improved adjustable-tilt footrests for wheelchairs. As such, the general purpose of the present invention, which will be described subsequently in greater comfort detail, is to provide a new and improved ADJUSTABLE-TILT FOOTRESTS FOR WHEELCHAIRS and method which has all the advantages of the prior art and none of the disadvantages.

To attain this, the present invention essentially comprises a new and improved adjustable-tilt footrest for wheelchairs comprising, in combination,a wheelchair with footrest supports having a pair of horizontal, parallel forwardly extending cylindrical rods. A pair of blocks, each block having an upper bore positioned to receive and support an associated cylindrical rod of the wheelchair, each block having a horizontal lower bore perpendicular to the upper bore. A pair of foot supporting plates, each plate adjustably supported with respect to the block, each pivot plate also having a pair of holes extending therethrough with bolts extending through the holes, each bolt having a complimentary nut. A pair of pivot bolts, each pivot bolt having a threaded end located adjacent to the side of the pivot block remote from the plate with a complimentary abutment surface and wingnut on opposite sides of the block for securing the pivot bolt to the block when positioned through the lower bore, each pivot bolt also having a pair of parallel holes extending therethrough aligned with the holes of the plate for securing the plate with respect to the bolt with a pair of small bolts and associated nuts to effect such coupling, whereby, loosening of the wingnuts will allow rotation of the pivot bolts and plates for the adjustment thereof and the tightening of the wingnuts will serve to secure the pivot bolt and plate in a proper angular orientation with respect to the block and wheelchair for maximum user comfort.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved adjustable-tilt footrests for wheelchairs which have all the advantages of the prior art supporting the feet of wheelchair users and none of the disadvantages.

It is another object of the present invention to provide new and improved adjustable-tilt footrests for wheelchairs which may be easily and efficiently manufactured and marketed.

It is further object of the present invention to provide new and improved adjustable-tilt footrests for wheelchairs which are of durable and reliable constructions.

An even further object of the present invention is to provide new and improved adjustable-tilt footrests for wheelchairs which are susceptible of a low cost of manufacture with regard to both materials and labor, and which accordingly are then susceptible of low prices of sale to the consuming public, thereby making such adjustable-tilt footrests for wheelchairs economically available to the buying public.

Still yet another object of the present invention is to provide new and improved adjustable-tilt footrests for wheelchairs which provide in the apparatuses and methods of the prior art some of the advantages thereof, while simultaneously overcoming some of the disadvantages normally associated therewith.

Still another object of the present invention is support the feet of users with adjustable footrests.

Lastly, it is an object of the present invention to provide new and improved wheelchair with footrest supports having a pair of horizontal, parallel forwardly extending cylindrical rods comprising, a pair of blocks, each block having an upper bore positioned to receive and support an associated cylindrical rod of the wheelchair, each block having a horizontal lower bore perpendicular to the upper bore. A pair of foot supporting plates, each plate adjustably supported with respect to the block, each plate also having a pair of holes extending therethrough with bolts extending through the holes, each bolt having a complimentary nut. A pair of pivot bolts, each pivot bolt having a threaded end located adjacent to the side of the pivot block remote from the plate with a complimentary abutment surface and wingnut on opposite sides of the block for securing the pivot bolt to the block when positioned through the lower bore, each pivot bolt also having a pair of parallel holes extending therethrough aligned with the holes of the plate for securing the plate with respect to the bolt with a pair of small bolts and associated nuts to effect such coupling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
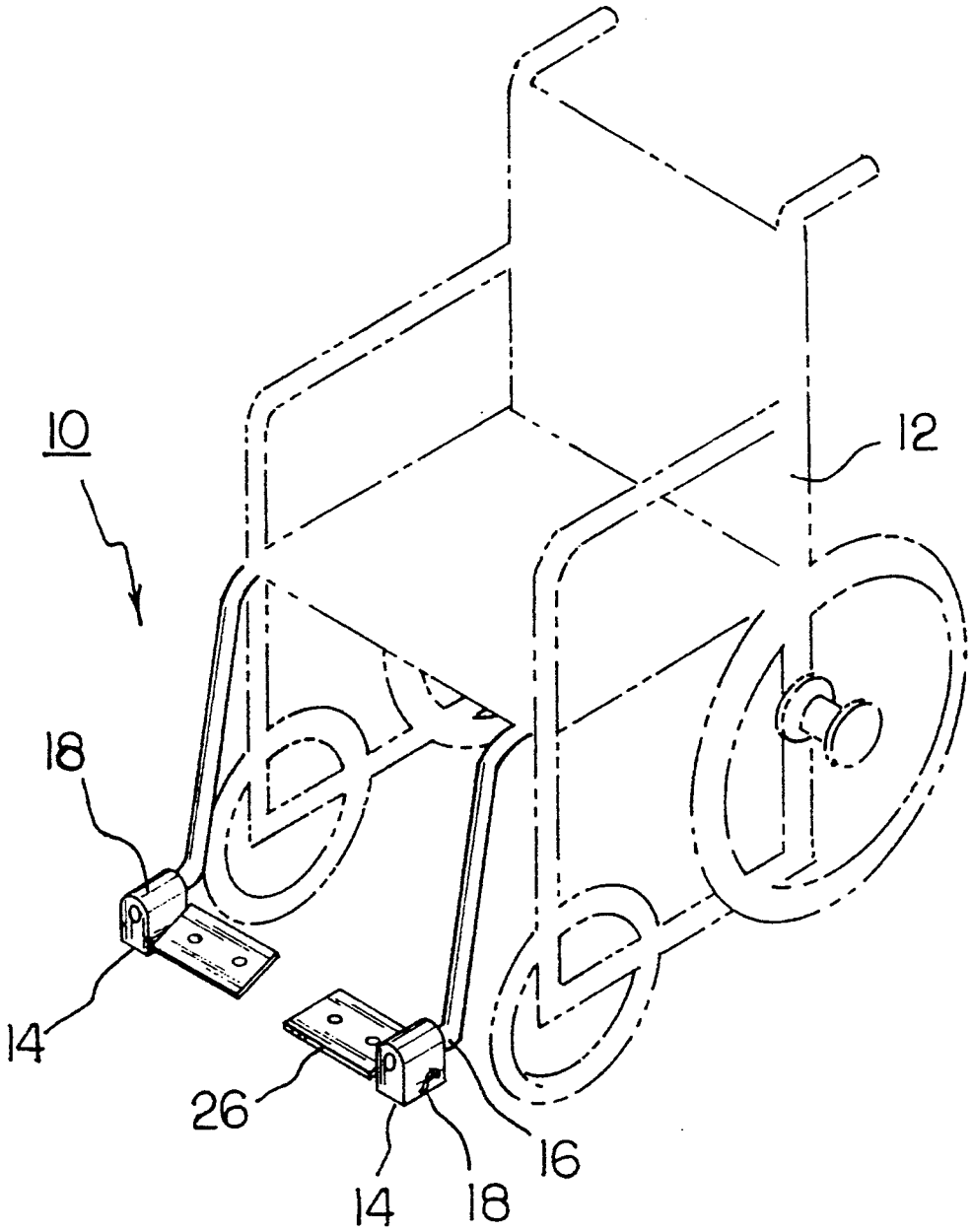
FIG. 1 is a perspective illustration of the preferred embodiment of the new and improved ADJUSTABLE-TILT FOOTRESTS FOR WHEELCHAIRS constructed in accordance with the principles of the present invention.
Figure 2:
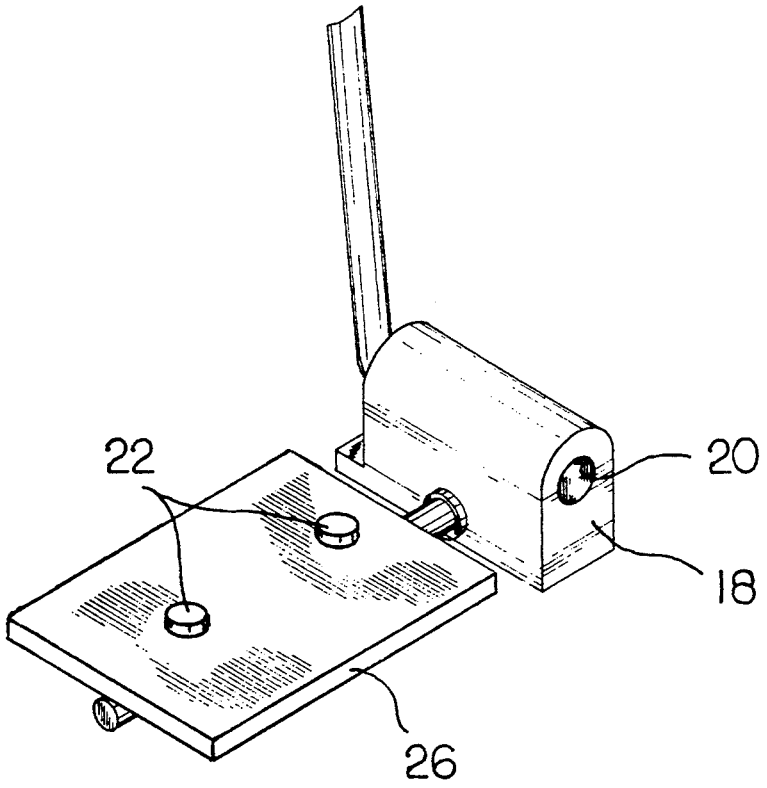
FIG. 2 is an enlarged perspective illustration of the adjustable footrest shown in FIG. 1.
Figure 3:
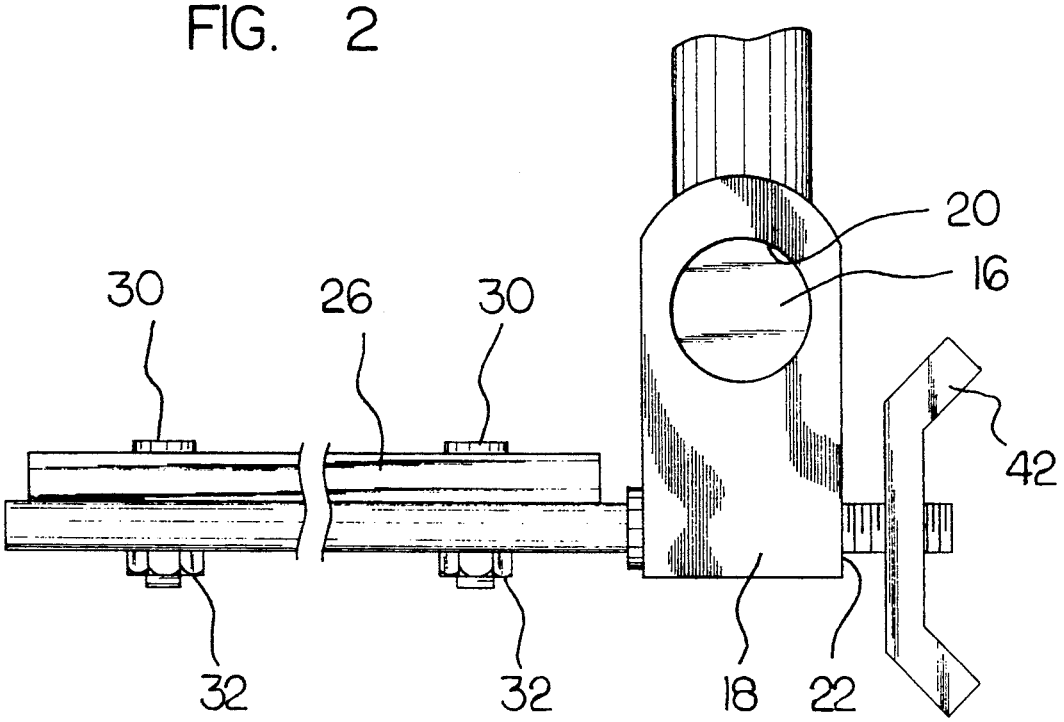
FIG. 3 is front elevational view of the block and footrest shown in FIGS. 1 and 2.
Figure 4:
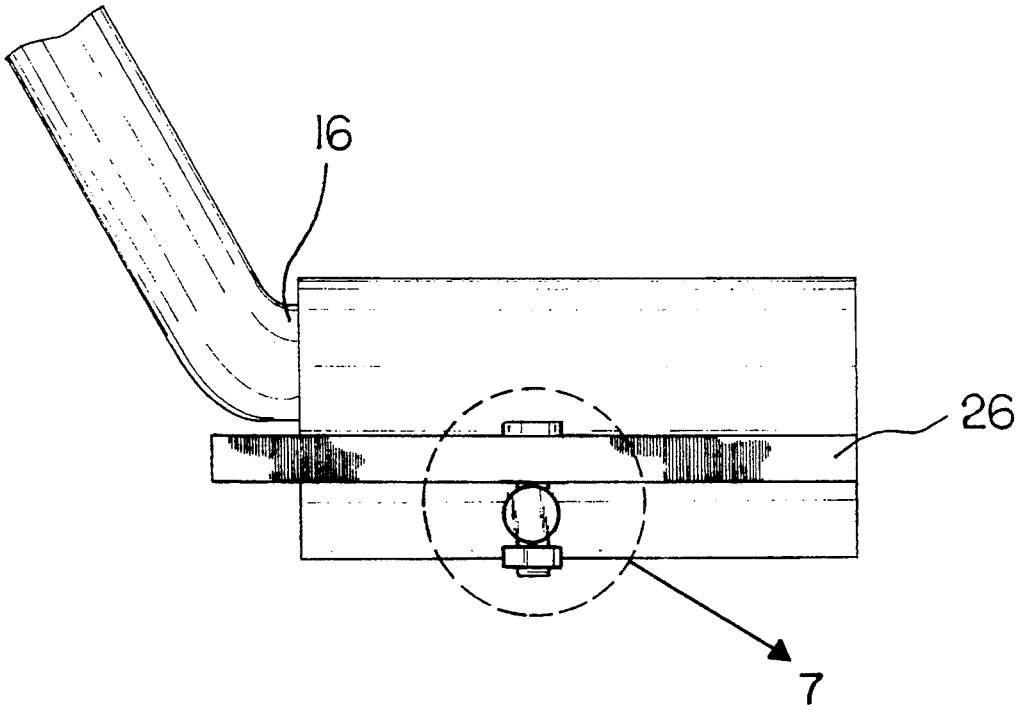
FIG. 4 is a side elevational view of the block and footrest of the prior figures.
Figure 5:
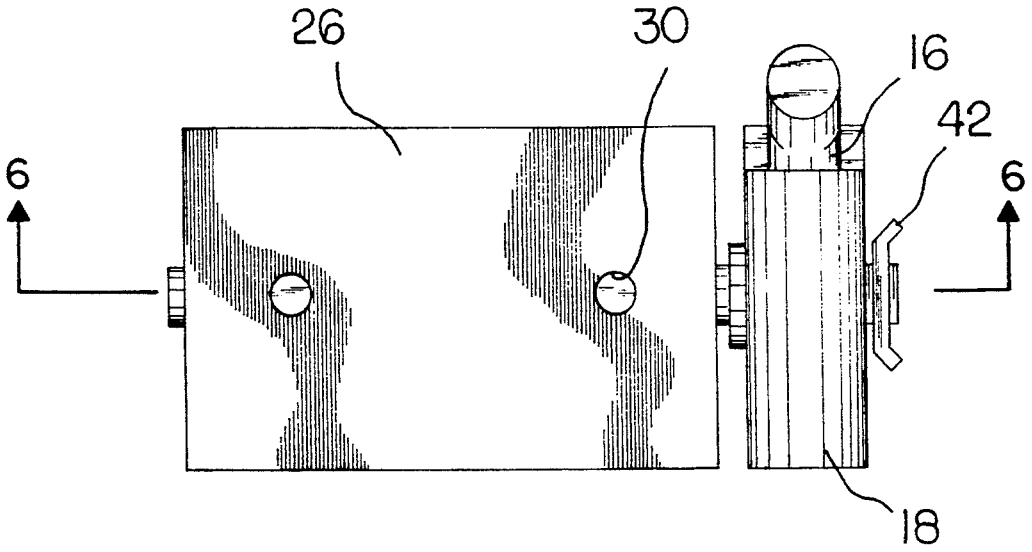
FIG. 5 is a plan view of the block and footrest of the prior figures.
Figure 6:
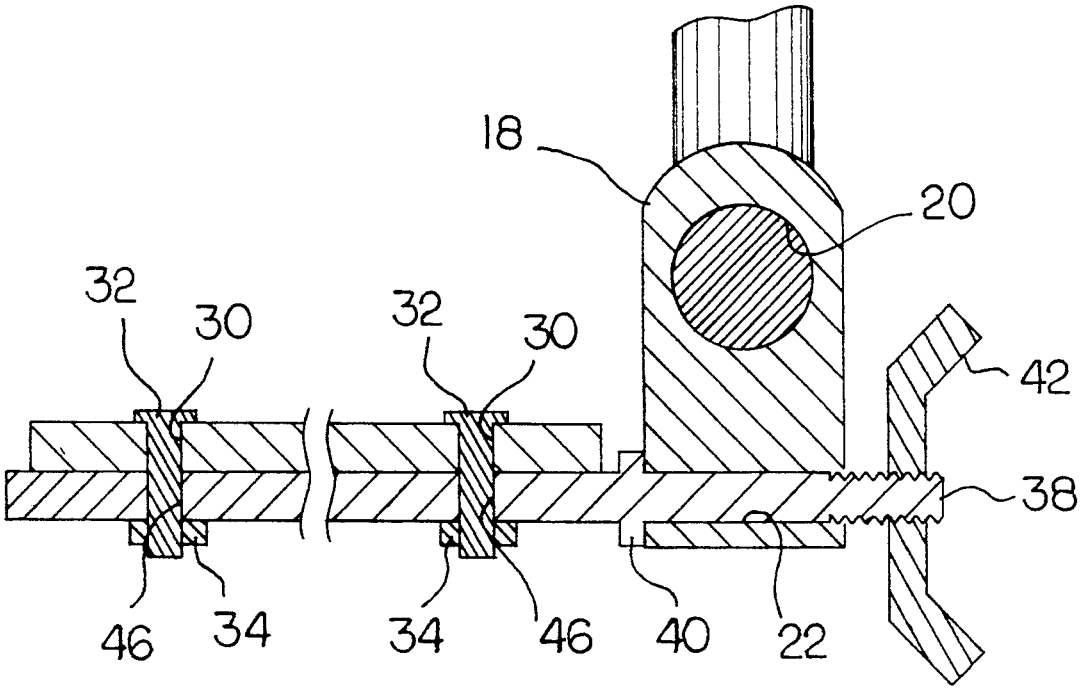
FIG. 6 is a cross-sectional view taken along lines 6—6 of FIG. 5.
Figure 7:
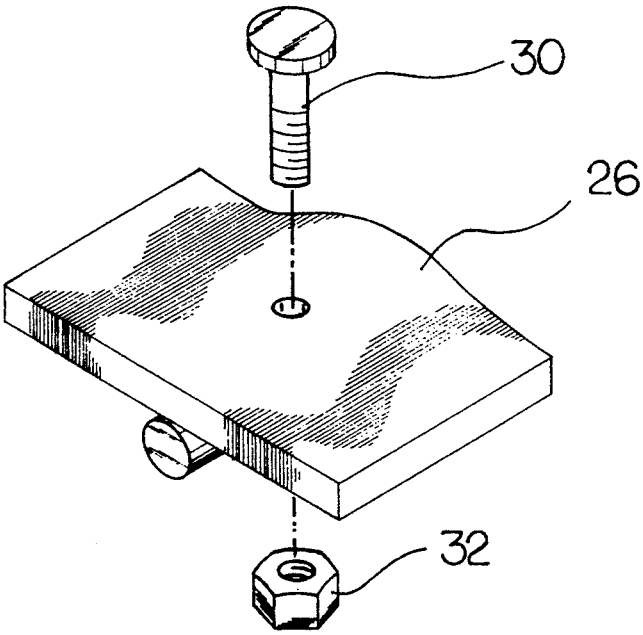
FIG. 7 is an enlarged showing of the coupling of the plate to the pivot rod taken at the circle of FIG. 4.

With reference now to the drawings, and in particular to FIG. 1 thereof, the preferred embodiment of the new and improved adjustable-tilt footrests for wheelchairs embodying the principles and concepts of the present invention and generally designated by the reference numeral 10 will be described.

Specifically, the present invention, the new and improved adjustable-tilt footrests for wheelchairs, is comprised of a plurality of individual components. The individual components are specifically configured and correlated one with respect to the other in order to obtain the desired objective.

More specifically, the invention includes a chair 12. The chair is provided with footrest supports 14 at a location for supporting the feet of a person seated in the wheelchair. The wheelchair also has a pair of horizontal parallel forwardly extending cylindrical rods 16. The rods function to hold the adjustable footrest in the appropriate orientation as desired.

The next component of the system is a pair of blocks 18. Each block is formed with an upper bore 20. Each bore is positioned to receive and support an associated cylindrical rod. In addition, each block also has a horizontal lower bore 22. Each lower bore is perpendicular to the upper bore.

Next provided are a pair of foot supporting plates 26. Each plate is located on the wheelchair to be adjustably supported with respect to the block. Each plate has a pair of holes 28 extending therethrough. Small bolts 30 and complimentary nuts 32 are provided to extend through the holes of the plates.

The last major component of the system is a pair of pivot bolts 36, one for each side of the device. Each pivot bolt has a threaded end 38. The threaded end of the pivot bolt extends through the lower bore of the block. The threads of the pivot bolt are on the side of the pivot block remote from the plates. An associated bearing surface 40 is located on the side of the block remote from the wingnut 42 whereby tightening of the wingnut will secure the pivot rod to the block while loosening of the wingnut will allow rotation of the pivot bolt with respect to the block.

Each pivot bolt also has a pair of small parallel holes 46. Such holes extend diametrically through the pivot bolt in alignment with the holes of the plate. This is for securing the plate with respect to the pivot bolt. Small bolts 38 and associated nuts 32 effect the coupling therebetween. In this manner, loosening of the wingnut will allow rotation of the pivot bolts and plates. Consequently, the plates and pivot bolts may be rotated to an appropriate angular orientation for the comfort of the user. The tightening of the wingnut with respect of the abutment surface and blocks will serve to secure the pivot bolt and plate in a preselected orientation for maximum comfort of the user.

The adjustable-tilt footrests for wheelchairs, as the name suggests, is designed to be mounted on a wheelchair for the purpose of elevating or lowering the footrest to any desired angle. The footrest itself is not rigidly mounted to a bracket, but instead, on two vertically oriented bolts which are engaged into a ½" diameter threaded carrier bolt. It is supported by the bracket and can be secured in any infinite position using a wingnut.

The adjustment of the footrest is made manually on a trial-and-error basis until the footrest is the most comfortable and uniform force distributing position for the occupant; this is done with the occupant of the chair in place. It is then a simple matter to tighten the wingnut to maintain this permanently angled position.

The adjustable-tilt footrests for wheelchairs is expressly made to compensate for the condition known as "dropfoot". For those suffering from this condition, the foot is permanently sloped in a forward and downward attitude, and if a conventional footrest is used, all of the force is exerted on the ball of the foot. This, in turn, causes blood vessel restriction at the pressure point and ultimate ulceration of the tissues in this area. The adjustable-tilt footrests for wheelchairs equalizes pressure over the entire bottom of the foot and eliminates the cause of this problem.

The adjustable-tilt footrests for wheelchairs is simply fabricated and can be inexpensively manufactured. As such, it could be attractively priced and a valuable acquisition for anyone confined to a wheelchair and suffering from the aforementioned condition. Of course, one need not necessarily be afflicted with dropfoot to enjoy the comfort provided by an angled footrest. It may be used on any chair to simply make the occupant more comfortable.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved adjustable-tilt footrest and wheelchair system comprising, in combination:

a wheelchair with footrest supports having a pair of horizontal, parallel forwardly extending cylindrical rods;

a pair of blocks, each block having an upper bore positioned to receive and support an associated cylindrical rod of the wheelchair, each block having a horizontal lower bore perpendicular to the upper bore;

a pair of foot supporting plates, each plate adjustably supported with respect to the block, each pivot plate also having a pair of holes extending therethrough with bolts extending through the holes, each bolt having a complimentary nut;

a pair of pivot bolts, each pivot bolt having a threaded end located adjacent to the side of the pivot block remote from the plate with a complimentary abutment surface and wingnut on opposite sides of the block for securing the pivot bolt to the block when positioned through the lower bore, each pivot bolt also having a pair of parallel holes extending therethrough aligned with the holes of the plate for securing the plate with respect to the bolt with a pair of small bolts and associated nuts to effect such coupling, whereby, loosening of the wingnuts will allow rotation of the pivot bolts and plates for the adjustment thereof and the tightening of the wingnuts will serve to secure the pivot bolt and plate in a proper angular orientation with respect to the block and wheelchair for maximum user comfort.

2. A wheelchair with footrest supports having a pair of horizontal, parallel forwardly extending cylindrical rods comprising:

a pair of blocks, each block having an upper bore positioned to receive and support an associated cylindrical rod of the wheelchair, each block having a horizontal lower bore perpendicular to the upper bore;

a pair of foot supporting plates, each plate adjustably supported with respect to the block, each plate also having a pair of holes extending therethrough with bolts extending through the holes, each bolt having a complimentary nut; and a pair of pivot bolts, each pivot bolt having a threaded end located adjacent to the side of the pivot block remote from the plate with a complimentary abutment surface and wingnut on opposite sides of the block for securing the pivot bolt to the block when positioned through the lower bore, each pivot bolt also having a pair of parallel holes extending therethrough aligned with the holes of the plate for securing the plate with respect to the bolt with a pair of small bolts and associated nuts to effect such coupling.

3. The device as set forth in claim 4 wherein the loosening of the wingnuts will allow rotation of the pivot bolts and plates for the adjustment thereof and the tightening of the wingnuts will serve to secure the pivot bolt and plate in a proper angular orientation with respect to the block and wheelchair for maximum user comfort.

* * * * *